US006166479A

United States Patent [19]

Matsutani et al.

[11] Patent Number: 6,166,479

[45] Date of Patent: Dec. 26, 2000

[54] SPARK PLUG HAVING A SPARK DISCHARGE PORTION WITH A SPECIFIC COMPOSITION

[75] Inventors: Wataru Matsutani, Nagoya; Ichiro Gonda, Konan, both of Japan

[73] Assignee: NGK Spark Plug Co., Ltd., Nagoya, Japan

[21] Appl. No.: 09/124,590

[22] Filed: Jul. 29, 1998

[30] Foreign Application Priority Data

Sep. 17, 1997 [JP] Japan ..... 9-272012

[51] Int. Cl.[7] ..... H01T 13/20

[52] U.S. Cl. ..... 313/141; 313/142

[58] Field of Search ..... 313/141, 142

[56] References Cited

U.S. PATENT DOCUMENTS

| | | | |
|---|---|---|---|
| Re. 35,429 | 1/1997 | Kondo | 313/141 |
| 5,557,158 | 9/1996 | Kanao et al. | 13/141 |
| 5,563,468 | 10/1996 | Abe et al. | 313/141 |
| 5,793,793 | 8/1998 | Matsutani et al. | 313/141 |
| 5,811,915 | 9/1998 | Abe et al. | 313/141 |
| 5,894,186 | 4/1999 | Matsutani et al. | 313/141 |
| 5,973,443 | 10/1999 | Chang et al. | 313/141 |
| 5,982,080 | 11/1999 | Shibata et al. | 313/141 |
| 5,990,602 | 11/1999 | Katoh et al. | 313/141 |
| 5,998,913 | 12/1999 | Matsutani | 313/141 |

FOREIGN PATENT DOCUMENTS

| | | |
|---|---|---|
| 196 23 795 A1 | 12/1996 | Germany . |
| 479540 | 2/1938 | Japan . |
| 8-339880 | 12/1996 | Japan . |
| 0 702 093 A1 | 3/1996 | United Kingdom . |
| 2 302 367 | 1/1997 | United Kingdom . |

*Primary Examiner*—Michael H. Day
*Assistant Examiner*—Mariceli Santiago
*Attorney, Agent, or Firm*—Brinks Hofer Gilson & Lione

[57] ABSTRACT

A spark plug includes a center electrode, an insulator provided outside the center electrode, a metallic shell provided outside the insulator, a ground electrode disposed to oppose the center electrode, and a spark discharge portion fixed on at least one of the center electrode and the ground electrode for defining a spark discharge gap. The spark discharge portion is formed from an alloy containing Ir as a main component, Rh in an amount of 0.2 to 10 wt. %, and Pt in an amount not greater than 10 wt. %. The ratio WPt/WRh of the Pt content to the Rh content falls within the range of 0.1–1.5.

20 Claims, 3 Drawing Sheets

SPARK PLUG HAVING A SPARK DISCHARGE PORTION WITH A SPECIFIC COMPOSITION

BACKGROUND OF THE INVENTION

1. Field of the Invention

The present invention relates to a spark plug used in an internal combustion engine.

2. Description of the Related Art

Conventionally, a spark plug for an internal combustion engine such as an automobile engine employs a Pt (platinum) alloy chip welded to an end of an electrode for use as a spark discharge portion with improved spark consumption resistance. However, due to expensiveness and a relatively low melting point of 1769° C., platinum is not satisfactory as a spark consumption resistant material for spark plug use. Thus, use of Ir (iridium), which is inexpensive and has a higher melting point of 2454° C., as a material for a chip has been proposed. However, since Ir tends to produce a volatile oxide and be consumed at a high temperature zone ranging from 900° C. to 1000° C., a spark discharge portion formed from Ir involves a problem of consumption stemming from oxidation/volatilization rather than spark consumption. Accordingly, an Ir chip shows good endurance under low temperature conditions as in traveling in an urban area, but has a problem of a significant reduction in endurance in continuous high-speed traveling.

Thus, an attempt has been made to suppress consumption of a chip stemming from oxidation/volatilization of Ir by adding an appropriate element to an alloy used as a material for a chip. For example, Japanese Patent Application Laid-Open (kokai) No. 9-7733 discloses a spark plug whose chip is improved in high-temperature heat resistance and consumption resistance by suppressing oxidation/volatilization of Ir through addition of Rh (rhodium).

However, an Ir—Rh alloy used as a chip material in the above-disclosed spark plug must contain a considerably large amount of Rh against consumption stemming from oxidation/volatilization in a continuous high-speed, high-load operation of an internal combustion engine. Since Rh is several times more expensive than Ir and has a relatively low melting point of 1970° C. as compared with that of Ir, an excessively large Rh content not only pushes up material cost of a chip but also involves insufficient resistance to spark consumption. That is, in recent years, operating conditions of spark plugs tend to become severer in association with an improvement in performance of internal combustion engines. Therefore, when such a chip is made from an Ir—Rh alloy and the Rh content of the alloy is increased considerably, sufficient resistance to spark consumption cannot be attained under certain operating conditions.

The aforementioned publication discloses endurance test results of a plug whose chip is formed from an alloy containing an Ir—Rh binary alloy as a base material and a third metal component, such as Pt or Ni, which is added to the base material in a manner of substituting for Ir. However, according to the endurance test results, the amount of consumption of a chip as observed after the endurance test is rather larger than that of a chip formed from an alloy into which neither Pt nor Ni is added, indicating that no improvement is achieved in the consumption resistance of such an Ir—Rh binary alloy.

SUMMARY OF THE INVENTION

An object of the present invention is to provide a spark plug whose spark discharge portion is formed from an Ir—Rh alloy, but which shows less susceptibility to consumption stemming from oxidation/volatilization of Ir at high temperatures as compared with a conventional spark plug whose spark discharge portion is formed from an Ir—Rh binary alloy, to thereby secure excellent endurance in city driving as well as in highway driving.

Another object of the present invention is to provide a spark plug whose spark discharge portion contains a smaller amount of expensive Rh than does a spark discharge portion of a conventional spark plug, to thereby reduce cost of manufacture, while securing good endurance.

According to the present invention, a spark plug comprises a center electrode, an insulator provided outside the center electrode, a metallic shell provided outside the insulator, a ground electrode disposed to oppose the center electrode, and a spark discharge portion fixed on at least one of the center electrode and the ground electrode for defining a spark discharge gap. The spark discharge portion of the spark plug is formed from an alloy containing Ir as a main component, Rh in an amount of 0.2 to 10 wt. %, and Pt in an amount not greater than 10 wt. %, wherein the ratio (WPt/WRh) of the Pt content WPt (wt. %) to the Rh content WRh (wt. %) is within the range of 0.1–1.5.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE INVENTION AND PREFERRED EMBODIMENTS

Figure 1:
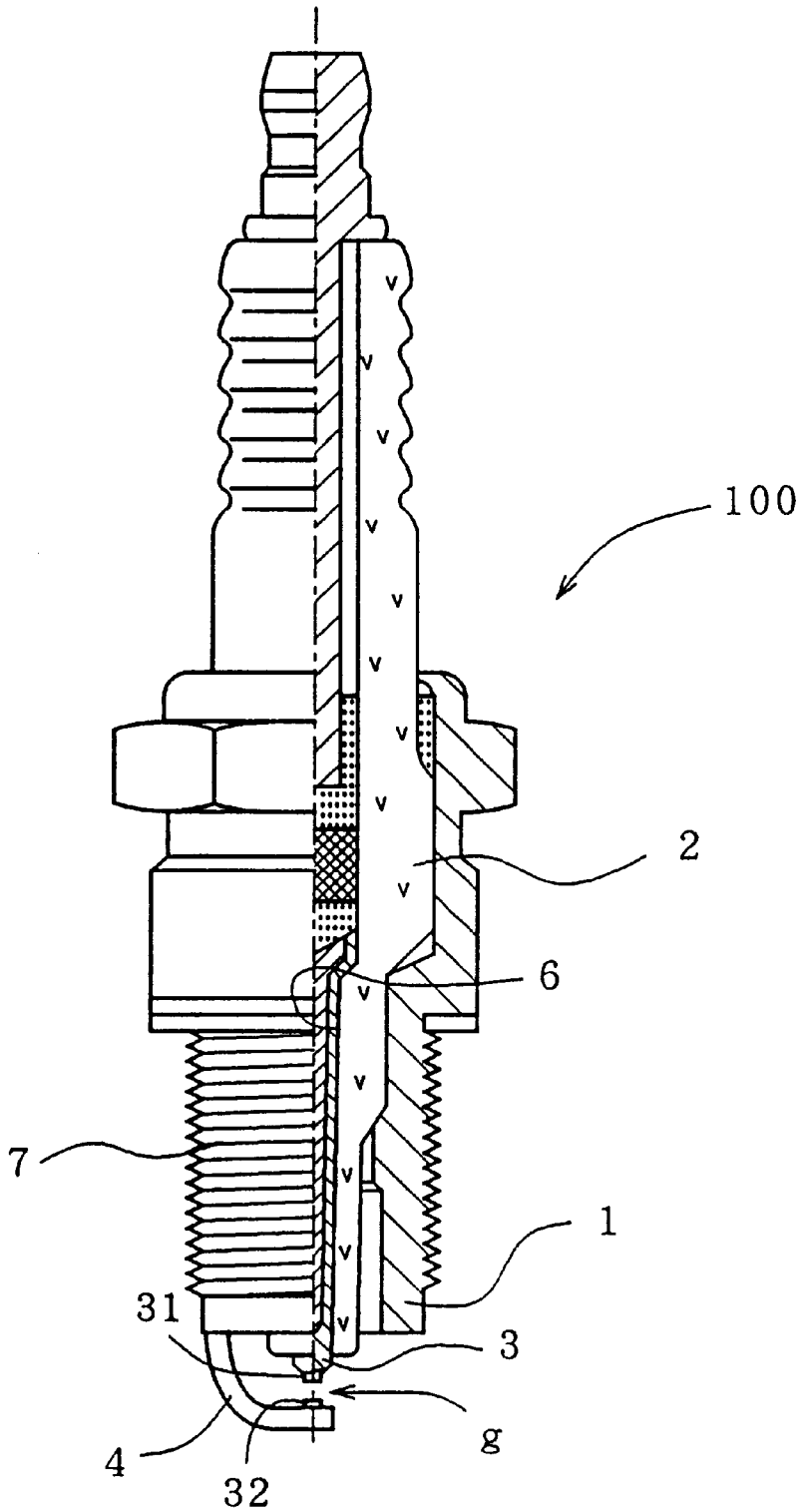
FIG. 1 is a semi-cross-sectional view of a spark plug according to the present invention.

The present inventors have found that a spark discharge portion of a spark plug formed from an alloy that contains Ir as a main component and that additionally contains Rh and Pt in amounts falling within the above-described specific ranges is far less susceptible to consumption stemming from oxidation/volatilization of Ir at high temperatures, so that the spark plug has excellent endurance. The characteristic feature of the spark plug of the present invention resides in the composition of the alloy that forms the spark discharge portion in which the content of Pt is set to not greater than 1.5 times that of Rh. Setting the Pt content in the above-described manner makes it possible to secure a sufficient degree of consumption resistance even when the Rh content is decreased greatly as compared with that of a conventional spark plug whose spark discharge portion is formed from an Ir—Rh binary alloy. Thus, spark plugs of high performance can be manufactured at reduced costs.

The aforementioned spark discharge portion is formed by welding a chip formed from an alloy having the aforementioned composition to a ground electrode and/or a center electrode. Herein, the "spark discharge portion" denotes a portion of a welded chip that is free from variations in composition caused by welding (i.e. other than the portion of the welded chip which has alloyed with a material of the ground electrode or center electrode due to welding).

When the Rh content of the above-described alloy exceeds 10 wt. %, the effect of suppressing oxidation/volatilization of Ir attained by addition of Pt is impaired, resulting in failure to achieve superiority over the conventional spark plug whose spark discharge portion is formed from an Ir—Rh binary alloy. When the Rh content becomes less than 0.2 wt. %, the effect of suppressing oxidation/volatilization of Ir becomes insufficient, so that the spark discharge portion comes to be easily consumed, resulting in failure to secure a required consumption resistance of the spark plug.

The effect of Pt addition to the suppression of oxidation/volatilization of Ir tends to become remarkable as the Rh content decreases. Especially, when the composition of the alloy is determined such that the Rh content is not greater than 8 wt. %, the addition of Pt remarkably enhances the effect of suppressing oxidation/volatilization of Ir at the spark discharge portion, which in turn enhances the consumption resistance of the spark discharge portion, resulting in even greater advantages over the conventional spark plug whose spark discharge portion is formed from an Ir—Rh binary alloy. The Rh content is preferably adjusted within the range of 0.2–3 wt. %, more preferably 0.5–2 wt. %.

When the Pt content exceeds 10 wt. %, the effect of suppressing oxidation/volatilization of Ir becomes insufficient, so that the spark discharge portion comes to be easily consumed, resulting in failure to secure a required consumption resistance of the spark plug. The ratio (WPt/WRh) of the Pt content WPt (unit: wt. %) to the Rh content WRh (unit: wt. %) is adjusted to be not greater than 1.5. When the ratio WPt/WRh exceeds 1.5, the effect of suppressing oxidation/volatilization of Ir may be impaired as compared with the case where Pt is not added. Meanwhile, when the ratio WPt/WRh becomes less than 0.1, the effect of suppressing oxidation/volatilization of Ir attained by addition of Pt is hardly expected. More preferably, the ratio WPt/WRh is adjusted to the range of 0.2–1.0.

Figure 4:
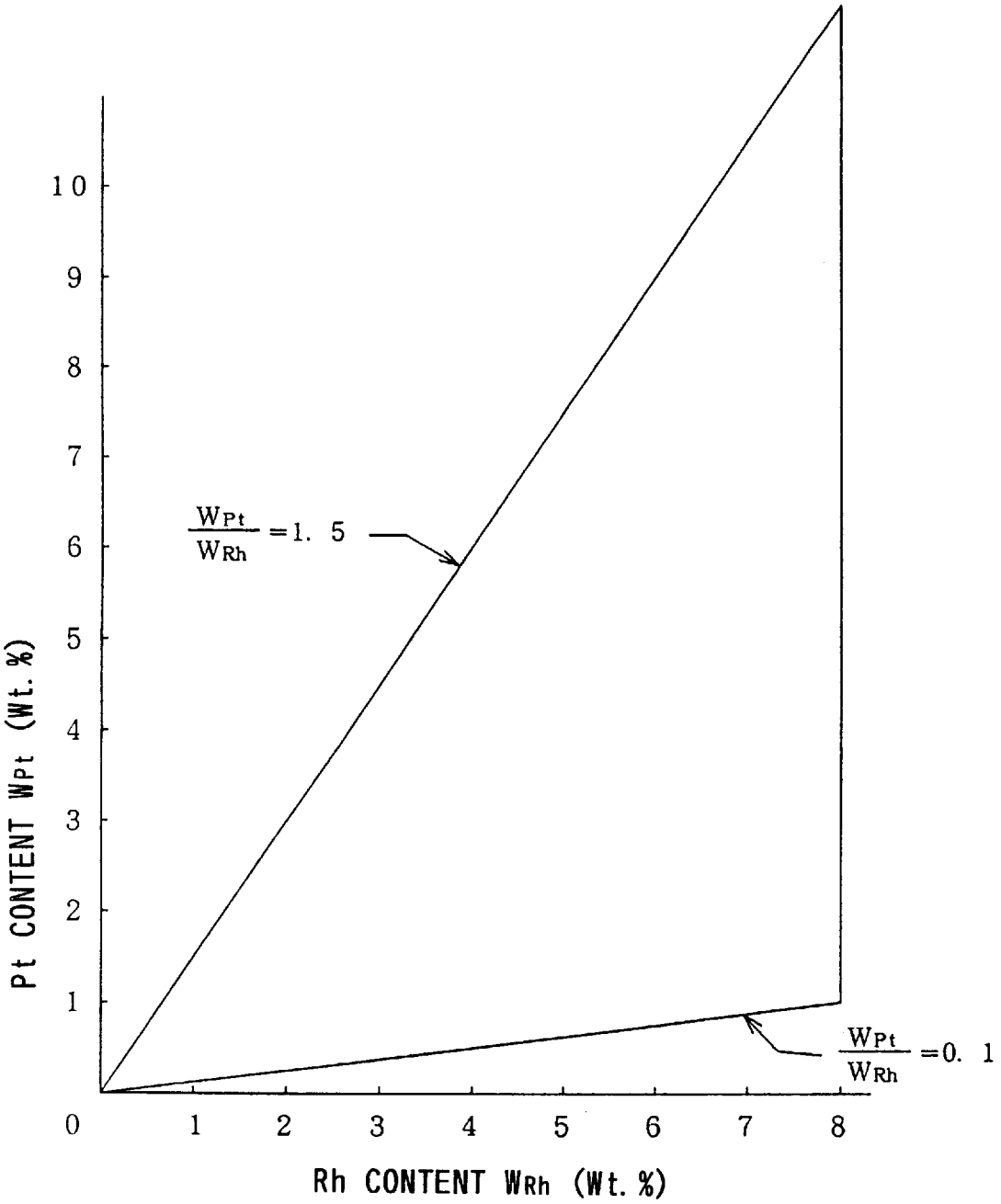
FIG. 4 is an explanatory view showing a desirable range of composition of the alloy, from which is formed the spark discharge portion of the spark plug of the resent invention.

The above means that the preferable range for the Pt content WPt of the material, from which the spark discharge portion is formed, varies depending on the Rh content WRh. That is, as shown in FIG. 4, the preferable range for the Pt content WPt is expressed by the area sandwiched between a straight line that represents WPt/WRh=1.5 and another straight line that represents WPt/WRh=0.1 on a two-dimensional WRh-WPt coordinate plane in which the vertical axis represents WPt and the horizontal axis represent WRh. For example, when the Rh content WRh is 1 wt. %, the Pt content WPt is preferably determined such that it falls within the range of 0.1–1.5 wt. %. Also, when the Rh content WRh is 2 wt. %, the Pt content WPt is preferably determined such that it falls within the range of 0.2–3 wt. %. Similarly, when the Rh content WRh is 3 wt. %, the Pt content WPt is preferably determined such that it falls within the range of 0.3–4.5 wt. %, and when the Rh content WRh is 4 wt. %, the Pt content WPt is preferably determined such that it falls within the range of 0.4–6 wt. %.

An alloy used as material for the spark discharge portion may contain an oxide (including a composite oxide) of a metallic element of group 3A (so-called rare earth elements) or 4A (Ti, Zr, and Hf) of the periodic table in an amount of 0.1 wt. % to 15 wt. %.

The addition of such an oxide more effectively suppresses consumption of Ir stemming from oxidation/volatilization of Ir. When the oxide content is less than 0.1 wt. %, the effect of adding the oxide against oxidation/volatilization of Ir is not sufficiently achieved. By contrast, when the oxide content is in excess of 15 wt. %, the thermal shock resistance of a chip is impaired; consequently, the chip may crack, for example, when the chip is fixed to an electrode through welding or the like. Preferred examples of the oxide include $Y_2O_3$ as well as $LaO_3$, $ThO_2$, and $ZrO_2$.

Next, embodiments of the present invention will now be described with reference to the drawings.

Figure 2:
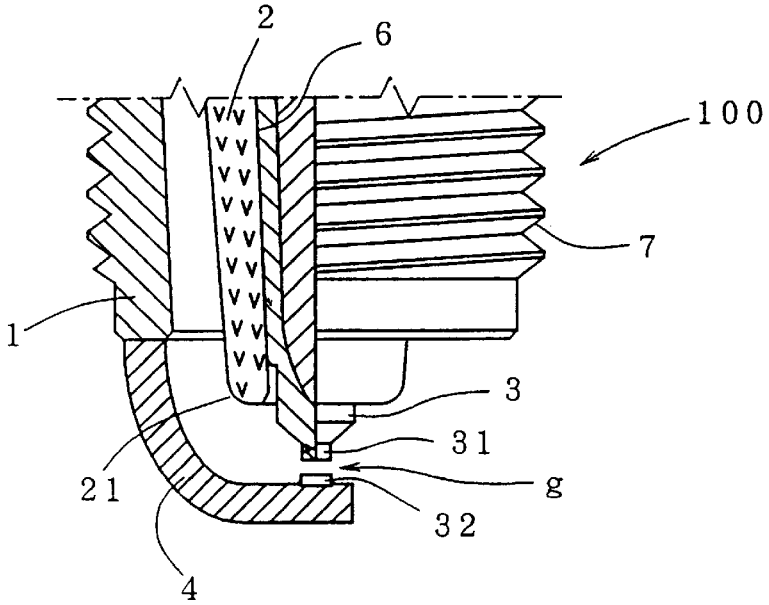
FIG. 2 is a partial cross-sectional view of the spark plug of FIG. 1.

As shown in FIGS. 1 and 2, a spark plug 100 includes a cylindrical metallic shell 1, an insulator 2, a center electrode 3, and a ground electrode 4. The insulator 2 is inserted into the metallic shell 1 such that a tip portion 21 of the insulator 2 projects from the metallic shell 1. The center electrode 3 is fittingly provided in the insulator 2 such that a spark discharge portion 31 formed at a tip of the center electrode 3 is projected from the insulator 2. One end of the ground electrode 4 is connected to the metallic shell 1 by welding or like method, while the other end of the ground electrode 4 is bent sideward, facing the tip of the center electrode 3. A spark discharge portion 32 is formed on the ground electrode 4 opposingly to the spark discharge portion 31. The spark discharge portions 31 and 32 define a spark discharge gap g therebetween.

The insulator 2 is formed from a sintered body of ceramics such as alumina ceramics or aluminum-nitride ceramics and has a hollow portion 6 formed therein in an axial direction of the insulator 2 for receiving the center electrode 3. The metallic shell 1 is tubularly formed from metal such as low carbon steel and has threads 7 formed on the outer circumferential surface and used for mounting the spark plug 100 to an engine block (not shown).

Bodies portions 3*a* and 4*a* of the center electrode 3 and ground electrode 4, respectively, are formed from a Ni alloy or like metal. The opposingly disposed spark discharge portions 31 and 32 are formed from an alloy containing Ir as a main component, Rh in an amount of 0.2 to 10 wt. % (preferably 0.2 to 8 wt. %, more preferably 0.2 to 3 wt. %, and most preferably 0.5 to 2 wt. %) and Pt in an amount not greater than 10 wt. %. Further, the ratio (WPt/WRh) of the Pt content WPt (unit: wt. %) to the Rh content WRh (unit: wt. %) is adjusted to fall within the range of 0.1–1.5 (preferably within the range of 0.2–1.0).

Figure 3:
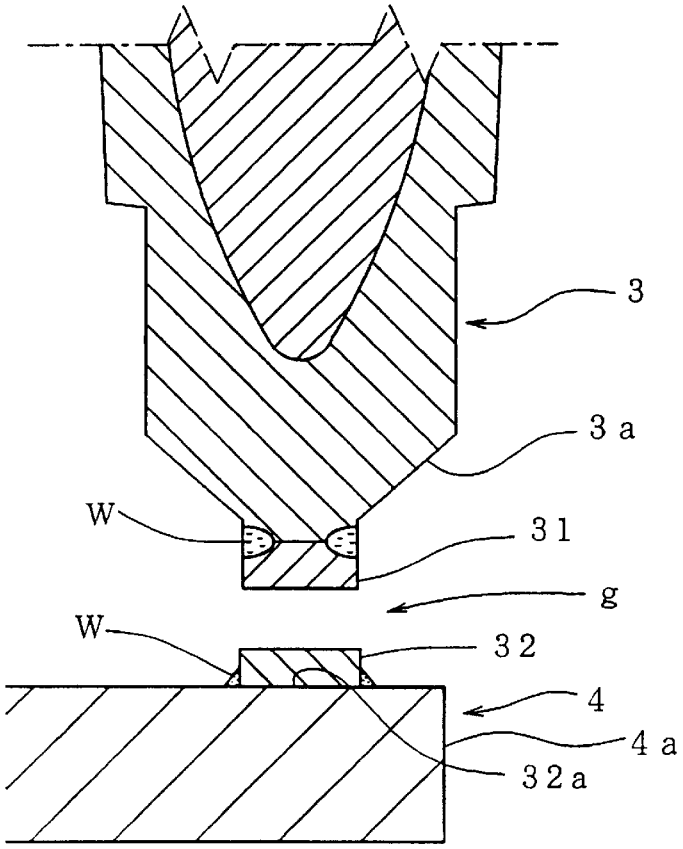
FIG. 3 is an enlarged cross-sectional view of essential portions of the spark plug of FIG. 1.

As shown in FIG. 3, the tip portion of the body 3*a* of the center electrode 3 is reduced in diameter toward the tip of the tip portion and has a flat tip face. A disk-shaped chip formed from the alloy described above as material for the spark discharge portion 31 is placed on the flat tip face. Subsequently, a weld zone W is formed along the outer circumference of the boundary between the chip and the tip portion by laser welding, electron beam welding, resistance welding, or like welding, thereby fixedly attaching the chip onto the tip portion and forming the spark discharge portion 31. Likewise, a chip is placed on the ground electrode 4 in a position corresponding to the spark discharge portion 31; thereafter, a weld zone W is formed along the outer circumference of the boundary between the chip and the ground electrode 4, thereby fixedly attaching the chip onto the ground electrode 4 and forming the spark discharge portion 32. These chips may be formed from a non-sintered alloy material or a sintered alloy material. The non-sintered alloy material is manufactured by mixing alloy components, melting them, and allowing to solidify. The sintered alloy material is manufactured by forming a green from powder of an alloy having the above-described composition or from a mixture powder of component metals mixed to obtain the above-described composition, and by sintering the green.

Either the spark discharge portion 31 or the spark discharge portion 32 may be omitted. In this case, the spark discharge gap g is formed between the spark discharge portion 31 and the ground electrode 4 or between the center electrode 3 and the spark discharge portion 32.

Next, the action of the spark plug 100 will be described. The spark plug 100 is mounted to an engine block by means of the threads 7 and used as an igniter for a mixture fed into a combustion chamber. Since the spark discharge portions 31 and 32, which are opposed to each other to form the spark discharge gap g therebetween, are formed from the aforementioned alloy, the consumption of the spark discharge portions 31 and 32 stemming from oxidation/volatilization of Ir is suppressed, and the spark consumption resistance of the spark discharge portions 31 and 32 is also improved through effective use of a material having a high melting point. Accordingly, the spark discharge gap g does not increase over a long period of use, thereby extending the service life of the spark plug 100. Further, since Pt is added to the Ir alloy of the spark discharge portion such that the Pt content does not exceed 1.5 times the Rh content, the content of the expensive Rh can be decreased as compared with a conventional spark plug whose spark discharge portion is formed from an Ir—Rh binary alloy. Thus, spark plugs of high-performance can be manufactured at reduced costs.

EXAMPLES

Example 1

Alloys containing Ir as a main component, Rh, and Pt in various compositions were manufactured by mixing Ir, Rh, and Pt in predetermined amounts and melting the resultant mixtures. The thus-obtained alloys were machined into disk-shaped chips, each having a diameter of 0.7 mm and a thickness of 0.5 mm. The pieces were used as test chips. These chips were allowed to stand at 1100° C. for 30 hours in the air and were then measured for reduction in weight (hereinafter referred to as "oxidation loss," unit: wt. %). The results are shown in Table 1.

TABLE 1

| WRh / WPt | 0.1 | 0.3 | 0.5 | 1.0 | 2.0 | 3.0 | 4.0 | 5.0 | 8.0 | 10.0 | 15.0 |
|---|---|---|---|---|---|---|---|---|---|---|---|
| 0 | 67 | 42 | 30 | 24 | 22 | 19 | 12 | 10 | 7 | 8 | |
| 0.1 | 43 | 16 | | 10 | | | | | | | |
| 0.3 | | 12 | 10 | 9 | 8 | 7 | 8 | | | | |
| 0.5 | | 22 | 18 | 8 | | 7 | 8 | | | | |
| 1.0 | | 31 | 26 | 11 | 7 | 7 | 8 | | | | |
| 2.0 | | | | 15 | 6 | 6 | | | | | |
| 3.0 | 58 | 54 | | 33 | 12 | 6 | | | | | |
| 4.0 | | | | | 26 | 11 | 7 | | | | |
| 5.0 | | | | | | 35 | 13 | 9 | 6 | 6 | |
| 8.0 | | | | | | | 36 | 30 | | | |
| 10.0 | | | | | | | | 52 | | | |
| 15.0 | | | | | | | | | 50 | 45 | |

As is apparent from Table 1, when chips are formed of the alloy according to the present invention, i.e., when chips are formed of an alloy in which the Rh content WRh is within the range of 0.2–10 wt. % and the Pt content WPt is adjusted such that the ratio WPt/WRh falls within the range of 0.1–1.5, the oxidation loss of the chips is relatively small, indicating that an Ir—Rh binary alloy is applicable to the spark discharge portion of a spark plug. Further, the effect of suppressing oxidation consumption attained by addition of Pt becomes remarkable when the Rh content WRh becomes equal to or less than 8 wt. %, especially remarkable when the Rh content WRh becomes equal to or less than 3 wt. %. Meanwhile, among alloys outside of the composition range of the present invention, alloys whose WPt/WRh ratio is greater than 1.5 generally exhibit a large oxidation loss, indicating a problem of poor consumption resistance. Further, when the Rh content WRh of the alloy is in excess of 10 Wt. %, the effect of suppressing oxidation loss attained by addition of Pt is not remarkable.

Example 2

Some of the chips manufactured in Example 1 were used to form the opposingly disposed spark discharge portions 31 and 32 of the spark plug 100 shown in FIG. 2. The spark discharge gap g was set to 1.1 mm. The performance of the thus-formed spark plugs was tested on a 6-cylindered gasoline engine (piston displacement: 2800 cc) under the following conditions: throttle completely opened, engine speed 5500 rpm, and 400-hour continuous operation (center electrode temperature: approx. 900° C.). After the test operation, the spark plugs were measured for an increase in the spark discharge gap g. The results are shown in Table 2.

TABLE 2

| Alloy composition (wt. %) | Gap increase (mm) |
|---|---|
| Ir - 0.3 Rh - 0.1 Pt | 0.31 |
| Ir - 1.0 Rh - 0.5 Pt | 0.27 |
| Ir - 2.0 Rh - 1.0 Pt | 0.23 |
| Ir - 5.0 Rh | 0.24 |
| Ir - 10 Rh | 0.21 |
| *Ir - 0.3 Rh - 5.0 Pt | 0.39 |
| *Ir | 0.40 |

* indicates that the composition is outside the scope of the present invention.

As is apparent from Table 2, in the spark plugs whose spark discharge portion is formed of an alloy in which the Rh content is 0.2–10 wt. % and the Pt content WPt is adjusted such that the WPt/WRh ratio falls within the range of 0.1–1.5, the amount of gap increase is small, and the spark discharge portions exhibit excellent consumption resistance. By contrast, in the spark plugs whose spark discharge portion is formed of an alloy whose WPt/WRh ratio is greater than 1.5, or to which Pt is not added, the amount of gap increase is large, and the spark discharge portions exhibit poor consumption resistance.

Obviously, numerous modifications and variations of the present invention are possible in light of the above teachings. It is therefore to be understood that within the scope of the appended claims, the present invention may be practiced otherwise than as specifically described herein.

The present disclosure relates to subject matter contained in Japanese Patent Application No. HEI 9-272012, filed on Sep. 17, 1997, which is expressly incorporated herein by reference in its entirely.

What is claimed:

1. A spark plug comprising:

a center electrode;

an insulator provided outside said center electrode;

a metallic shell provided outside said insulator;

a ground electrode disposed to oppose said center electrode; and a spark discharge portion fixed on at least one of said center electrode and said ground electrode for defining a spark discharge gap, said spark discharge portion being formed from an alloy containing Ir as a main component, Rh in an amount of 0.2 to 10 wt. %, and Pt in an amount of at least 0.1 wt. % and not greater than 10 wt. %, wherein the ratio (WPt/WRh) of the Pt content WPt (wt. %) to the Rh content WRh (wt. %) is within the range of 0.1–1.5.

2. A spark plug according to claim 1, wherein said alloy contains Rh in an amount of 0.2 to 8 wt. %.

3. A spark plug according to claim 2, wherein the composition of said alloy is adjusted such that the ratio WPt/WRh falls within the range of 0.2–1.

4. A spark plug according to claim 2 further comprising an oxide of a metallic element of group 3A or 4A or a composite thereof in an amount of 0.1 to 15 wt %.

5. A spark plug according to claim 4 wherein the metallic oxide is selected from $Y_2\mathbf{0}_3$, $LaO_3$, $ThO_2$ and $ZrO_2$.

6. A spark plug according to claim 1, wherein said alloy contains Rh in an amount of 0.2 to 3 wt. %.

7. A spark plug according to claim 6, wherein the composition of said alloy is adjusted such that the ratio WPt/WRh falls within the range of 0.2–1.

8. A spark plug according to claim 6 further comprising an oxide of a metallic element of group 3A or 4A or a composite thereof in an amount of 0.1 to 15 wt %.

9. A spark plug according to claim 8 wherein the metallic oxide is selected from $Y_2O_3$, $LaO_3$, $ThO_2$ and $ZrO_2$.

10. A spark plug according to claim 1, wherein said alloy contains Rh in an amount of 0.5 to 2 wt. %.

11. A spark plug according to claim 10, wherein the composition of said alloy is adjusted such that the ratio WPt/WRh falls within the range of 0.2–1.

12. A spark plug according to claim 10 further comprising an oxide of a metallic element of group 3A or 4A or a composite thereof in an amount of 0.1 to 15 wt %.

13. A spark plug according to claim 12 wherein the metallic oxide is selected from $Y_2O_3$, $LaO_3$, $ThO_2$ and $ZrO_2$.

14. A spark plug according to claim 1, wherein the composition of said alloy is adjusted such that the ratio WPt/WRh falls within the range of 0.2–1.

15. A spark plug according to claim 1 further comprising an oxide of a metallic element of group 3A or 4A or a composite thereof in an amount of 0.1 wt % to 15 wt %.

16. A spark plug according to claim 15 wherein the metallic oxide is selected from $Y_2O_3$, $LaO_3$, $ThO_2$ and $ZrO_2$.

17. A spark plug comprising:

a center electrode;

an insulator provided outside said center electrode;

a metallic shell provided outside said insulator;

a ground electrode disposed to oppose said center electrode; and a spark discharge portion fixed on at least one of said center electrode and said ground electrode for defining a spark discharge gap, said spark discharge portion being formed from an alloy containing Ir as a main component, Rh in an amount of 0.2 to 10 wt. %, and Pt in an amount of at least 0.1 wt. % and not greater than 10 wt. %, and wherein the amount of Pt is not greater than 1.5 times the amount of Rh.

18. A spark plug comprising:

a center electrode;

an insulator provided outside said center electrode;

a metallic shell provided outside said insulator;

a ground electrode disposed to oppose said center electrode; and a spark discharge portion fixed on at least one of said center electrode and said ground electrode for defining a spark discharge gap, said spark discharge portion being formed from an alloy containing Ir as a main component, Rh in an amount of 0.2 to 10 wt. %, and Pt in an amount expressed by the area between a straight line that represents WPt/WRh=1.5 and a straight line that represents WPt/WRh=0.1 on a two-dimensional WRh-WPt coordinate plane in which the vertical axis represents WPt and the horizontal axis represents WRh.

19. A spark plug according to claim 18 farther comprising an oxide of a metallic element of group 3A or 4A or a composite thereof in an amount of 0.1 wt % to 15 wt. %.

20. A spark plug according to claim 19 wherein the metallic oxide is selected from $Y_2O_3$, $LaO_3$, $ThO_2$ and $ZrO_2$.

* * * * *